United States Patent [19]

Profrock, Jr.

[11] Patent Number: 4,926,942

[45] Date of Patent: May 22, 1990

[54] METHOD FOR REDUCING SAND PRODUCTION IN SUBMERSIBLE-PUMP WELLS

[76] Inventor: William P. Profrock, Jr., 5122 Lawn Arbor, Houston, Tex. 77066

[21] Appl. No.: 313,716

[22] Filed: Feb. 22, 1989

[51] Int. Cl.[5] ..... E21B 43/12

[52] U.S. Cl. ..... 166/250; 166/53; 166/66.4; 166/369; 166/370; 417/26; 417/45

[58] Field of Search ..... 166/370, 371, 373, 369, 166/53, 65.1, 66.4, 68, 105, 250; 417/44, 45, 20, 26, 18, 19

[56] References Cited

U.S. PATENT DOCUMENTS

| | | | |
|---|---|---|---|
| 3,563,311 | 2/1971 | Stein | 166/369 X |
| 3,568,771 | 3/1971 | Vincent et al. | 166/66.4 X |
| 3,610,779 | 10/1971 | Hubby | 417/44 X |
| 3,705,532 | 12/1972 | Hubby | 166/369 X |
| 4,037,663 | 7/1977 | Buchman | 166/369 |
| 4,102,394 | 7/1978 | Botts | 417/45 X |
| 4,370,098 | 1/1983 | McClain et al. | 417/45 X |
| 4,798,247 | 1/1989 | Deaton et al. | 166/373 |

OTHER PUBLICATIONS

Wilson, Evaluating Cycling of Electrical Submersible Pumps (1984).

*Primary Examiner*—Stephen J. Novosad
*Attorney, Agent, or Firm*—Arnold, White & Durkee

[57] ABSTRACT

A method for minimizing the production of sand in submersible-pump well applications is disclosed, in which control of fluid production rates is used to maintain a low rate of change of formation pressure. Simulation of well drawdown conditions in advance of startup allow the prediction of well performance and the selection of a drawdown profile to be implemented in control systems.

4 Claims, 8 Drawing Sheets

METHOD FOR REDUCING SAND PRODUCTION IN SUBMERSIBLE-PUMP WELLS

BACKGROUND

The Appendix to this disclosure contains copyrighted material. Permission is granted to make copies of the Appendix solely in connection with making copies of the patent, and for no other purpose.

This application relates to well production and electric submersible pump (ESP) systems; specifically, it relates to a method for aiding selection and optimization of pump apparatus by simulating the well drawdown process.

Basics of Pumping Apparatus

FIG. 1 is a simplified illustration of a wellbore configuration. The well comprises a casing 10 which extends downward from the surface to a formation 12 which contains a fluid under pressure. Casing 10 has numerous perforations 14 in the region adjoining formation 12 to allow fluid to pass from the formation 12 into the casing 10. The region of the casing having perforations is sometimes referred to as the "perforation zone".

Inside casing 10 is a production tubing assembly 16 which hangs vertically within casing 10 from the above-ground well structure (not depicted). Production tubing assembly 16 comprises a pump 18 having an intake for the well fluid, and usually also includes a number of components not discussed here such as motors, electrical cables, and gas separators.

The intake for pump 18 is submerged in the well fluid, which partially fills casing 10. Perforations 14 allow well fluid to pass into casing 10 and partially fill it, to a level 20. Fluid level 20 is referred to as the "static fluid level", because it is the level to which the column of fluid rises when the pump is inactive.

Fluid is forced to the static level 20 by the upward force of the formation pressure, which is designated SIBHP (shut-in bottom hole pressure) for an inactive, or "shut in", well. When the downward weight of the column of fluid equals the force of the fluid pushed upward by the formation pressure, fluid stops rising within the casing.

Well Drawdown

Well drawdown refers to the process occurring upon startup of pump 18. The pump activity reduces fluid pressure in the area surrounding the pump intake. This causes the level of fluid within casing 10 to go down; as the pressure of formation 12 is released, the weight of the casing column of fluid will oppose this pressure reduction. The column of fluid will drop from its static level 20 until equilibrium is reached again at a producing level 22, as depicted in FIG. 2.

FIG. 2 depicts the actions taking place upon startup of the pump 18 of FIG. 1 Pump 18 extracts fluid at a rate $Q_t$ consisting of a portion of formation fluid $Q_f$ and a portion of fluid $Q_a$ from the casing-tubing annulus:

$$Q_t = Q_a + Q_f$$

Fluid level 22 is the level reached when the pump is operational and the upward force of the formation pressure balances the downward force of the column of fluid. When level 22 is reached, the well is said to be stabilized and producing.

The drop from level 20 to level 22 corresponds to a pressure change $\Delta P$ in the pump region of the formation, so that the pressure $P_{wf}$ in the pump region is reduced from its original value by an amount $\Delta P$:

$$P_{wf} = SIBHP - \Delta P$$

When the well has reached its stabilized producing stage, all of the fluid pumped then comes from the formation (i.e., $Q_t = Q_f$ and $Q_a = 0$).

The Vogel Relation

The relationship between production rates and formation pressures has been modelled in several approximate relationships. One widely used approximation is the Vogel relation:

$$Q_o/Q_{omax} = 1 - 0.2(P_{wf}/P_r) - 0.8(P_{wf}/P_r)^2$$

Using this relation, one can find $Q_{omax}$, or the maximum rate of production. $P_r$ in this equation is static pressure (SIBHP), and $P_{wf}$ is pressure of the formation. FIG. 4 is a graph of the Vogel relation.

Vogel's relation is not the only approximation used to aid in predicting well performance. For example, another well-known approximation is the straight-line productivity index:

$$Q_o = Q_{omax}(1 - P_{wf}/P_r)$$

The straight-line productivity index may be used in similar fashion to the Vogel relation above to determine the maximum rate of production.

Dynamic Head

When selecting a submersible pump for a given well, it is necessary to select one powerful enough to overcome the difference in elevation between the fluid column in the casing and the surface. This difference is often called the "head" or "dynamic head". Dynamic head also may refer to the pressure in the wellbore as a result of this vertical difference.

In electric submersible pump systems, the total dynamic head (TDH) is commonly taken as the sum of vertical lift, frictional loss, and any surface pressure:

$$TDH = H_{lift} + H_{friction} 30\ H_{surface\ pressure}$$

The vertical lift component is the primary component of TDH, corresponding to the difference in elevation. Friction loss may be calculated for a given length and diameter of tubing using methods well known to those of ordinary skill. Surface pressure is any back pressure or pressure in tubing at the surface impeding the production of fluid.

Sand in Formations

One major problem in submersible pump system has been that the well drawdown process typically causes the movement of sand particles with a formation. If the formation pressure $P_{wf}$ changes abruptly, as might occur upon startup of the well pump, pressure differences within the formation may loosen or wash away sand particles, and cause sane to be produced with the well fluid.

Production of sand is highly undesirable. Sand passing through the pump and intake causes premature wear and abrasion, and shortens the useful life of the pump.

Referring to FIGS. 3*a* and 3*b*, a cross-section of wellbore 10 occupies only a very small area of a typical formation 12. In FIG. 3*a*, the well is assumed to be shut in, and $P_{wf}=P_r$, the shut in bottom hole pressure. The pressure throughout the formation is $P_r$ in all locations. FIG. 3*b* shows the formation immediately after drawdown begins. At the wellbore 10, formation pressure $P_{wf}$ is reduced. However, at some distance x from the wellbore, the formation pressure is still $P_r$; pressure does not instantaneously change for all locations within the formation.

The pressure difference $P_r-P_{wf}$ causes heavy instantaneous fluid flow, increasing the probability that the fluid carries sand with it. Thus if the rate of change of pressure $dP_{wf}/dt$ is lessened, sand production is inhibited.

SUMMARY OF THE INVENTION

In accordance with the invention, a method for determining a desirable well startup profile minimizes sand production by ensuring that pressure differentials within a formation remain within prescribed limits throughout the drawdown process.

An iterative technique may be used to accurately estimate, from fixed pump parameters and well performance data, the rate of change of formation pressure $dP_{wf}/dt$. Fixed pump parameters include the particular pump configuration used, the size and length of tubing, and the size of the well casing.

To reduce the rate of change of formation pressure, one may limit the initial rate of production, keeping $dQ_t/dt$ low so as to keep $dP_{wf}/dt$ low.

The production rate may be controlled using two techniques or a combination of the two: (1) varying the frequency of AC power delivered to the pump motor (slowing the pump action); or (2) applying back pressure to impede the flow of fluid produced (e.g., controlling production flow using a valve or the like). Implementation of a startup profile according to the invention may be controlled through a computer, monitoring and altering production rates as needed.

In fact, drawdown may be controlled using little or no feedback if a desired profile (rate of fluid production versus time) is determined in advance of well startup, and used to direct computer control of drawdown. A computer or terminal unit at the well site may regulate production rates according to a preset profile, enabling more precise and accurate control of well startup.

BRIEF DESCRIPTION OF DRAWINGS

The invention, while particularly set forth in the appended claims, may be understood more easily upon reading the following detailed description of specific embodiments, in which:

DETAILED DESCRIPTION OF SPECIFIC EMBODIMENTS

1. Profile Control Using Input Power Frequency

Using a variable-frequency motor in a submersible pump allows a high degree of control over the drawdown process. In brief, when the frequency of AC current is increased or decreased, the pump rate is increased or decreased also in a linear proportion:

$$Pump\ Rate_f=(f/60)Pump\ Rate_{60Hz}$$

For a frequency f, the pump rate is (f/60) times the 60 Hz pump rate. Likewise, the total dynamic head required is dependent on the power input frequency f squared, so that:

$$TDH_f=(f/60)^2TDH_{60Hz}$$

Figure 1:
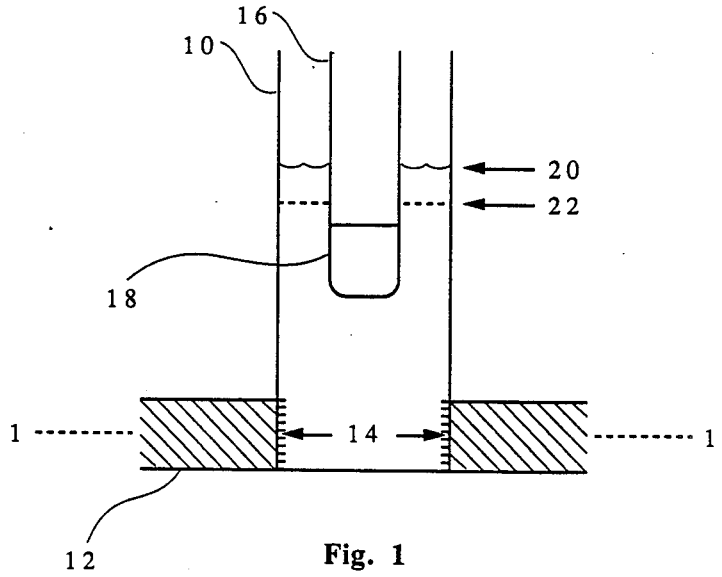
FIG. 1 is a simplified illustration of an inactive (non-pumping) wellbore.
Figure 2:
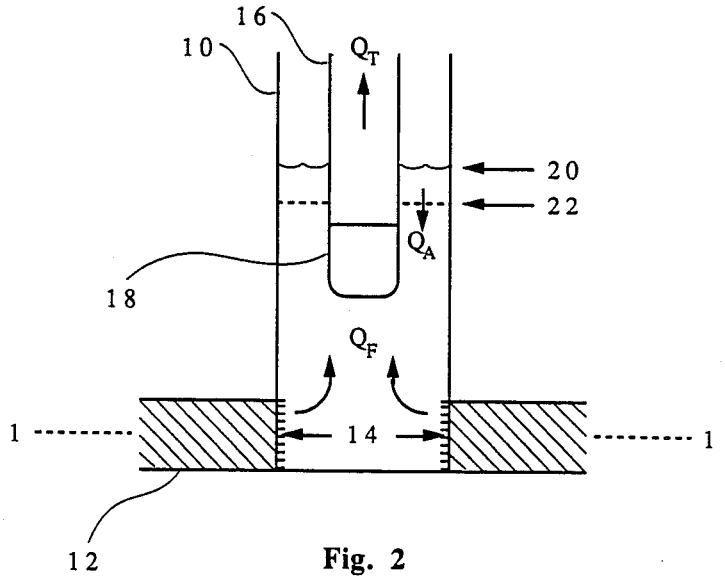
FIG. 2 depicts the wellbore of FIG. 1 upon startup of the pump 18.
Figure 3A:
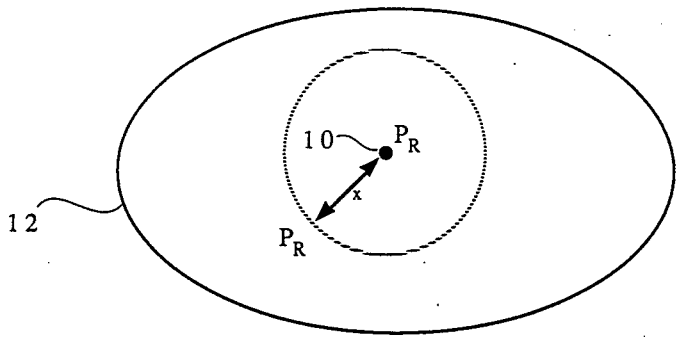
FIGS. 3*a* and 3*b* represent a formation taken along the line 1—1 of FIG. 1 and depict a shut in and a producing well, respectively.
Figure 3B:
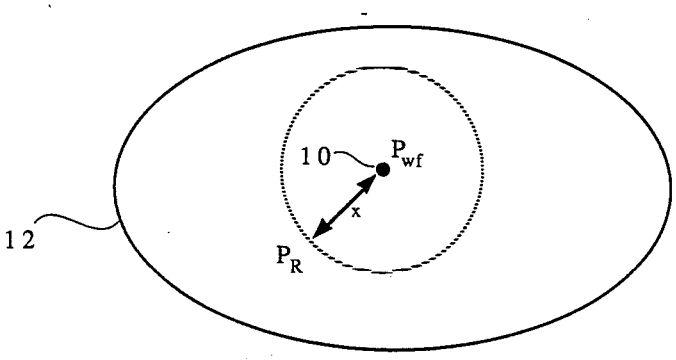
Figure 4:
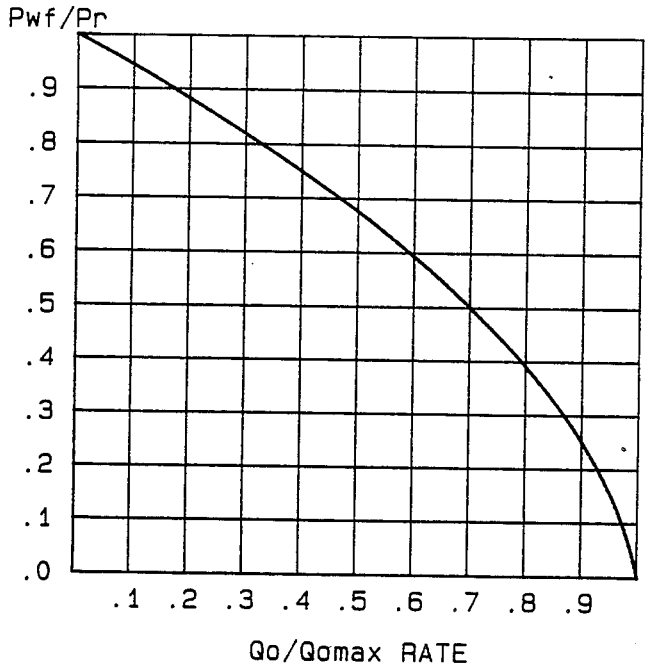
FIG. 4 is a graph of Vogel's inflow performance relation.
Figure 5:
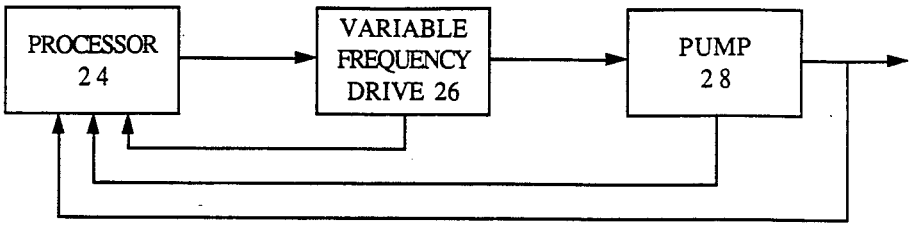
FIG. 5 is a block diagram depicting a control system which varies the frequency of power input to a motor.

FIG. 5 depicts a control system having a processor 24, variable frequency drive 26, and pump system 28. Feedback from the drive 26 and pump 28 indicate to the processor whether it should increase or decrease the input frequency of the drive. Signals which may be monitored include pressure at the pump intake, surface pressure, fluid level in the casing, and rate of production.

2. Profile Control Using Back Pressure

Figure 6:
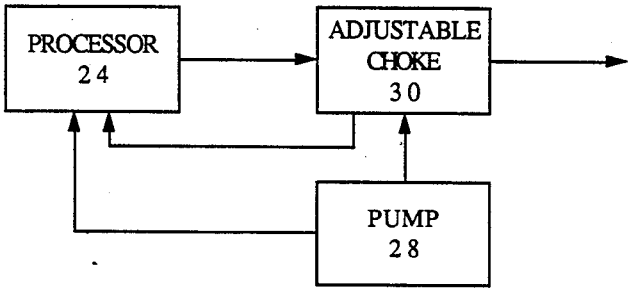
FIG. 6 is a block diagram depicting a control system which uses an adjustable choke.

FIG. 6 illustrates a control system which limits the rate of production using a variable choke. Feedback signals such as production rate, fluid level, pressure at the pump intake, and choke position may be returned to the processor 24. Processor 24 opens or closes choke 30 by the degree necessary to optimize drawdown.

The power input frequency of pump 28 is not altered in this example, having no signal input from the processor 24. However, the pump rate, or rate of fluid through the pump, is varied through surface pressure resulting from choke 30. The necessary surface pressure profile may be predetermined for the processor 24 for a given well and pump configuration to automate the operation of choke 30.

3. Profile Control Using Fluid Circulation

Figure 7:
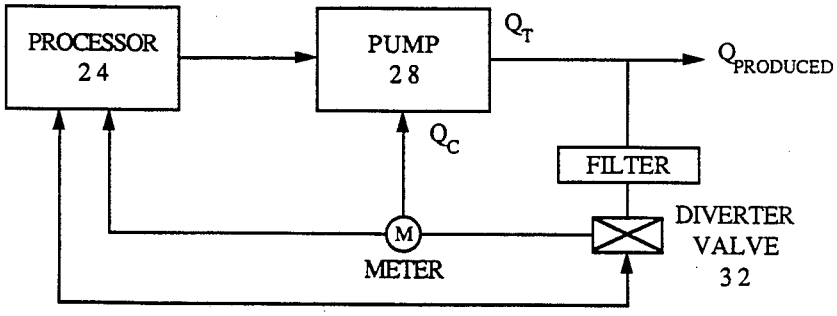
FIG. 7 is a block diagram depicting a control system which uses a diverter valve to return fluid to the casing.

Control of the drawdown process may also be accomplished through the use of a diverter valve as in FIG. 7. Under control of the processor 24, the diverter 32 recirculates an amount of fluid $Q_c$, sending it back into the casing to pass through pump 28 another time. Total fluid produced $Q_p$ is equal to $Q_t$, the total through the pump, minus $Q_c$:

$$Q_p=Q_t-Q_c$$

Feedback of the diverter's position and the amount of recirculated fluid enable the processor 24 to control the diverter 32 opening much in the same manner that it controls choke 30 in Example 2.

4. Control With Advance Selection of Desired Profile

The methods described above provide a limited measure of control over the drawdown process. Greater control and optimization of drawdown may be achieved by programming an on-site computer such as processor 24 to implement a predetermined profile of fluid production rate versus time.

Determination of an optimal profile can be made using iterative techniques which predict the effects of uncompensated (fixed production rate) drawdown to enable the user to select a preferable drawdown. The following example will help in illustrating this.

Example: Pump Selection

Given the following hypothetical data, one can select a suitable size pump for a specific well and predict its performance:

SIBHP=1700 psi; $P_{wf}$=1692 psi;
$Q_0$=200 BPD in initial test
Center of perforations: 5200'
Desired production rate $Q_0$=1440 BPD
Tubing: 2.5" diameter, in average condition
Specific gravity of water=1.07
Formation pressure $P_r$=285 psi Using Vogel's equation described earlier, one can solve for the maximum fluid production rate $Q_{0max}$=23661 BPD. The desired eventual rate is $Q_0$=1440 BPD, so Vogel's equation may be solved again with $P_{wf}$ as the unknown to determine the formation pressure of the well when producing. After translating the calculated pressure into feet of head, the result is $P_{wf}$=3618 ft. above the perforation center.

The working fluid level forms the vertical lift component of head; $WFL=5200-3618=1582$ ft. Surface pressure in feet of head is also calculated:

$$H_{sp}=(285\text{ psi})(2.31\text{ ft/psi})/1.07=628\text{ ft.}$$

Frictional loss in the tubing may be accounted for using the Hazen-Williams method well known in the art. In this example, the loss amounts to 87 feet in head.

Total dynamic head is the sum of these three components:

$$TDH=1582+628+87=2298\text{ ft.}$$

For this hypothetical example, a 132-stage DN1300, manufactured by Reda-Camco, provides adequate pumping capability.

Simulation of Drawdown

When a pump has been selected to match the well, then a simulation program can be run to determine the effects of uncompensated drawdown, using pump and well test data as initial variables. The Appendix contains BASIC source code for one such program.

The simulation program is iterative, calculating a production rate $Q_{tn}$ on each iteration n, based on fluid level and formation pressure $P_{wfn}$. During the simulated time interval t between iterations n and (n+1), a volume of fluid is produced which may be used to determine a new fluid level and formation pressure $P_{wfn+1}$. A new pump rate $Q_{tn+1}$ is then calculated. This iterative technique continues until the pump rate has stabilized.

The drop x in fluid level on successive iterations can be used to determine the portion of fluid $Q_a$ from the casing-tubing annulus. The rate from formation $Q_f=Q_t-Q_a$ may thus be determined.

Figure 8:
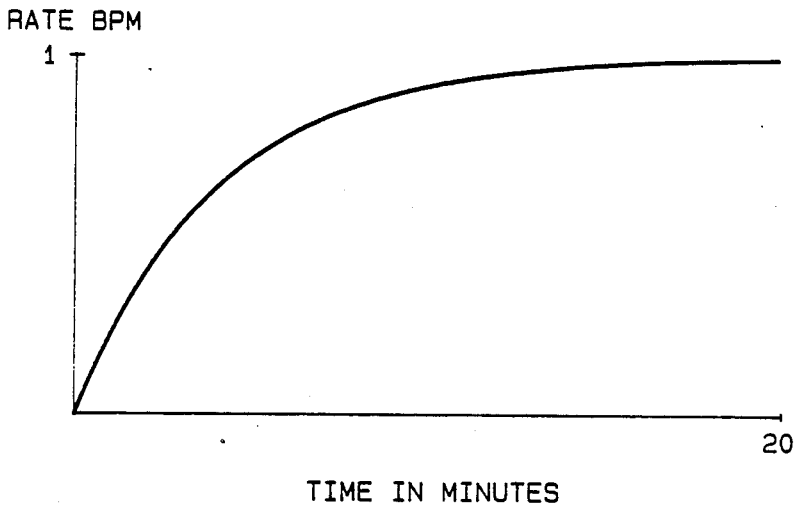
FIG. 8 depicts a rate from formation that has a large initial variation with time.
Figure 9:
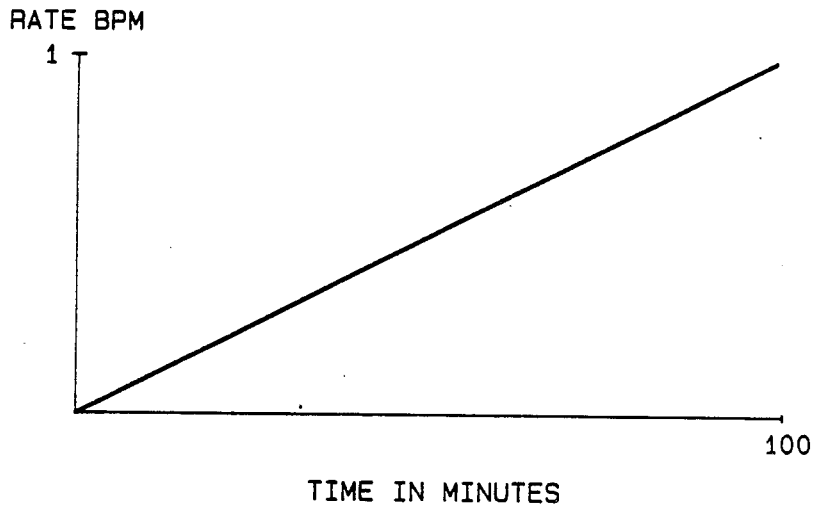
FIG. 9 depicts a rate from formation varying linearly with time.

A typical uncompensated well will draw down with a rate from formation that varies with time as in FIG. 8. The user may then choose a preferred profile which reduces the slope of this plot as much as possible. FIG. 9 depicts one such design choice. The rate from formation changes at a constant rate. Other profiles may be selected, of course, depending on the user's specific needs.

Simulation of Compensated Drawdown

Following selection of a desired formation rate profile, it is necessary to determine a corresponding profile of production rate $Q_t$ versus time. Another iterative test, similar to the simulation program described above, can be used to determine the production rate profile to implement in controls.

Controlling the production rate may be accomplished using one of the methods discussed earlier: (1) varying power input frequency to a variable-speed pump; (2) adjusting a choke to limit fluid passage; and (3) diverting fluid back into the well. This example will illustrate the use of a variable-speed pump.

Total Dynamic Head

Total dynamic head varies with the power input as shown earlier:

$$TDH_f=(f/60)^2 TDH_{60Hz}$$

Figure 10:
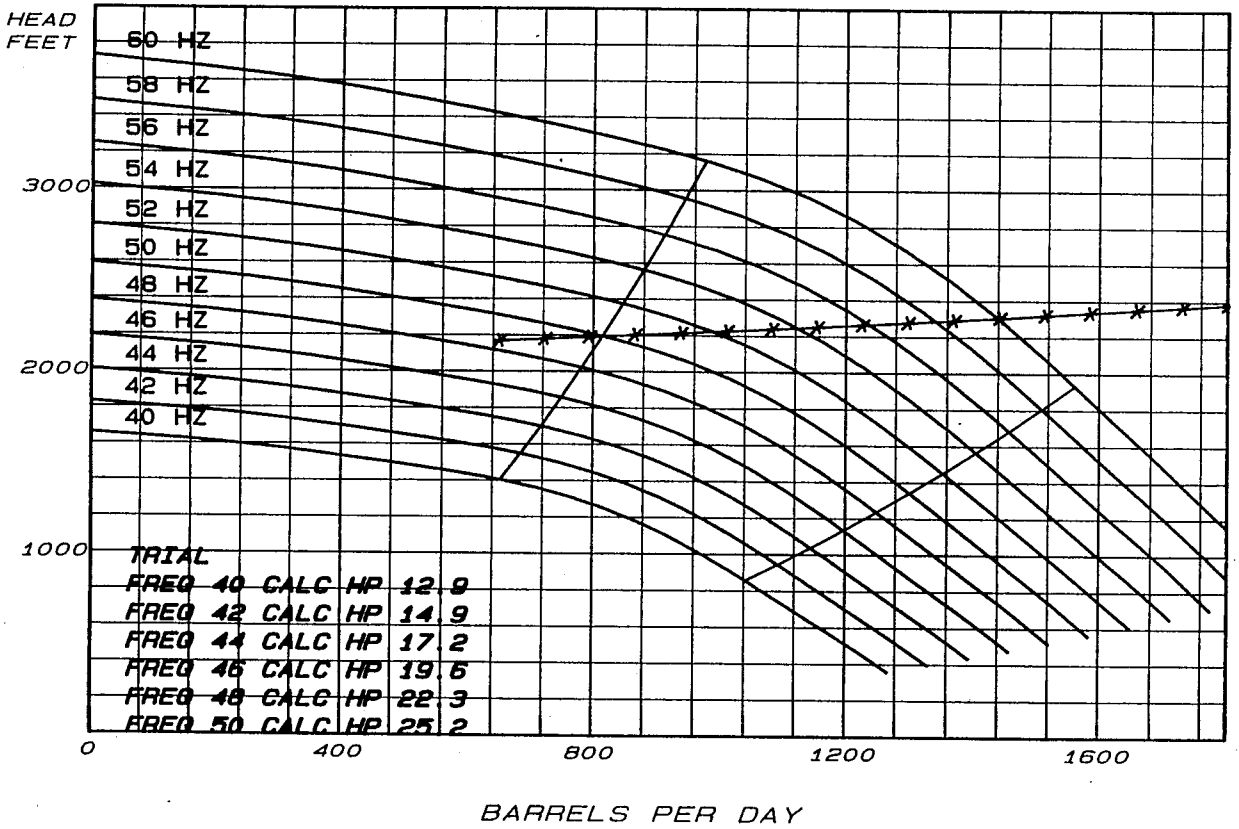
FIG. 10 is a graph depicting a family of curves for TDH at different frequencies, with a production rate superimposed on those curves.

The TDH curve may be expanded into a family of curves for different frequencies as shown in FIG. 10. Against this family of curves is plotted the production rates (which change in dynamic head as the surface pressure and fluid level in the casing changes).

The TDH curve for a pump is usually available from the pump's manufacturer, but may also be represented mathematically through regression analysis as a polynomial $$A_nQ^n+A_{n-1}Q^{n-1}+\ldots+A_1Q+A_0$$

For the simulation performed in the course of implementing this invention, the polynomials used were from 8th- to 15th-degree.

Figure 11:
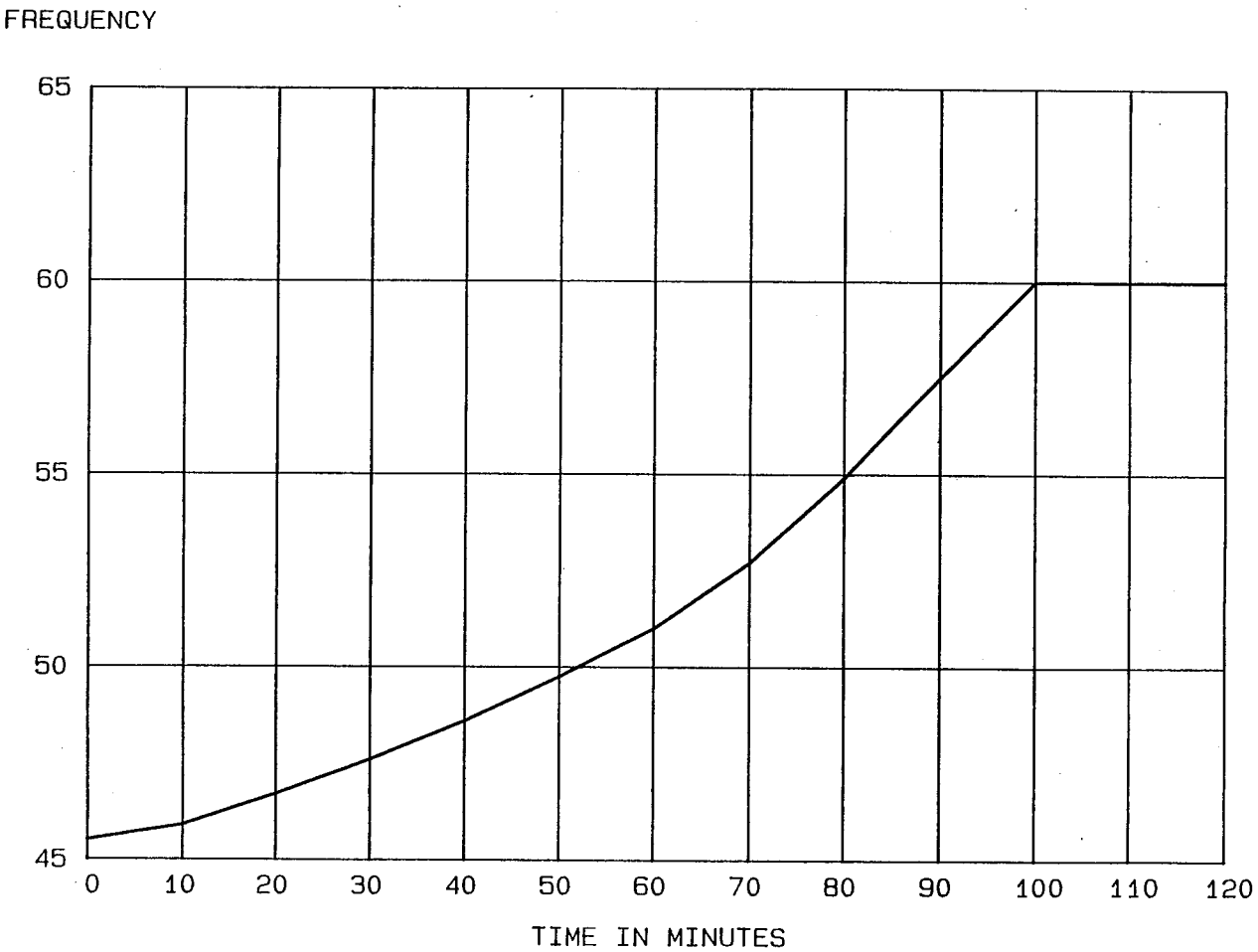
FIG. 11 is a graph of power frequency versus time to implement a selected production rate profile from the example.

From the plots of FIG. 10, it is possible to determine a profile of power input fequency versus time corresponding to the earlier profile of fluid production rate versus time. This frequency-time relationship, depicted in FIG. 11, may be implemented using a control system as shown in FIG. 5.

It will, of course, be apparent to those of ordinary skill having the benefit of this disclosure that the above embodiments do not represent all of the ways that the invention may be practiced. Thus it is noted that the invention is intended to be limited only by the scope of the appended claims.

Copyright - © 1989
(unpublished)

*SOUTHWEST ANALYSIS & TESTING, INC.*
*13700 VETERANS MEMORIAL DRIVE, SUITE 257*
*HOUSTON, TEXAS 77014*
*713-444-4250*

Submersible Pump Drawdown Analysis:

```
800 DIM X(25)
820 DIM Y(25)
830 CHDIR "\"
840 REM*gosub29800 has been deleted***
860 DEF FNW(W)=INT(W+.5)
880 DEF FND(D)=INT(D*100+.5)/100
1000 DEF FNT(G)=INT(G*10+.5)/10
1020 REM*************************
1040 REM*pump performance program*
1060 REM*************************
1080 LPRINT CHR$(27);"N";CHR$(14)
1100 LPRINT CHR$(27);"E"
1120 LPRINT CHR$(27);"4"
1140 LPRINT TAB(20); "SOUTHWEST ANALYSIS & TESTING, INC."
1160 LPRINT TAB(17); "13700 VETERANS MEMORIAL DRIVE, SUITE 257"
1180 LPRINT TAB(25); "HOUSTON, TEXAS  77014"
1200 LPRINT TAB(30); "713-444-4250"
1220 LPRINT CHR$(27); "5"
1240 LPRINT
1260 LPRINT"Submersible Pump Drawdown Analysis:"
1280 LPRINT CHR$(27); "F"
1300 LPRINT
1320 LPRINT"Well Name"
1340 INPUT"input well name";WELL$
1360 LPRINT""
1380 LPRINT"     ";WELL$
1400 LPRINT
1420 INPUT"wellhead pressure in psi";WHP
1440 LPRINT"wellhead pressure";"   ";WHP;"  psi"
1460 LPRINT
1480 INPUT"depth to fluid in feet";FL
1500 LPRINT"depth to fluid";"      ";FL;"  feet"
1520 LPRINT
1540 INPUT"tubing ID inches";DIA
1560 LPRINT"tubing ID           ";DIA;" inches"
```

Appendix to
"Method for Reducing Sand
Production in Submersible-Pump
Wells" by W. P. Profrock, Jr.

```
1580 LPRINT
1600 INPUT"tubing condition: new, avg, or old";C$
1620 LPRINT"tubing condition:     ";C$
1640 IF C$="old" OR C$="OLD" THEN C=100
1660 IF C$="avg" OR C$="AVG" THEN C=120
1680 IF C$="new" OR C$="NEW" THEN C=140
1700 IF C=<0 THEN  1600
1720 LPRINT"the c factor used"
1740 LPRINT"for ";C$;" tubing is   ";C
1760 LPRINT
1780 INPUT"specific gravity of water";SGW
1800 LPRINT"sp. gr. of water    ";SGW
1820 LPRINT
1840 INPUT"pump type";PTYP$
1860 LPRINT"pump type     ";PTYP$
1880 LPRINT
1900 INPUT"number of stages";NUM
1920 LPRINT"number of stages    ";NUM
1940 LPRINT
1960 INPUT"pump setting depth in feet";PD
1980 LPRINT"pump setting depth  ";PD;"  feet"
2000 LPRINT
2020 INPUT"center of perforations";COP
2040 LPRINT"center of perforations ";COP;"  feet"
2060 LPRINT
2080 INPUT"shut in bottom-hole pressure";SIBHP
2100 LPRINT"shut in bottom hole pressure ";SIBHP;" psi"
2120 LPRINT
2140 INPUT"Qo max (Vogel curve)";QOM
2160 LPRINT"Qo max used is ";QOM;" bbls/day"
2180 LPRINT
2200 SPGR=SGW
2220 FAP=PD-FL
2240 PIP=CHP+(FAP*.433*GAPI)
2260 WHPFT=(WHP*2.31)/SPGR
2270 CHDIR "APUMPS"
2280 REM****revised pgm starts here****
2300 CTR=0
2320 BIN=0
2340 FCL=0
2360 MIN=1
2380 BPM=0:QA=0:QF=0
2400 BBLS=0
2420 CBD=0
2440 F$=PTYP$
2460 IS=0
2480 GOSUB 4860
2500 FOR KK= 1 TO 25
2520 GOSUB 4980
2540 X(KK)=VAL(P$)
2560 IF FCL=-1 THEN 2600
2580 GOTO 2620
2600 J=IS:KK=25
2620 NEXT KK
2640 MAX=X(J-2)
2660. PMAX=MAX
2680 PRINT"  qt now equals";QT
```

```
2700 KK=0:J=0:GG=0:NN=0:P=0
2720 FCL=0
2740 REM*******************
2760 REM*get pump tdh data*
2780 REM*******************
2800 F$=PTYP$
2820 IS=0
2840 GOSUB 4660
2860 FOR KK= 1 TO 25
2880 GOSUB 4980
2900 X(KK)=VAL(P$)
2920 IF FCL=-1 THEN 2960
2940 GOTO 2980
2960 J=IS:KK=25
2980 NEXT KK
3000 GOSUB 4760
3020 FOR CBD=1 TO 6
3040 INCR=(MAX/(10^CBD))
3060 FOR QT=BIN TO MAX STEP (MAX/(10^CBD))
3080 QT=QT/10^X(J)
3100 CTDH=X(1)
3120 NN=J-6
3140 FOR GG=1 TO NN
3160 CTDH=CTDH+X(GG+1)*QT^GG
3180 NEXT GG
3200 QT=QT*10^X(J)
3220 QCTR=QT
3240 CTDH=CTDH*10^X(J)
3260 LL=X(J-4)
3280 UL=X(J-3)
3300 ML=X(J-2)
3320 HP=X(J-1)
3340 CTDH=NUM*CTDH
3360 GOSUB 5360
3380 TDHC=FL+WHPFT+FLOSS
3400 CTR=CTR+1
3420 REM***the following goto deletes diagnostic printout***
3440 GOTO 3520
3460 LPRINT"rate is";QT;"pump tdh";CTDH;"well tdh";TDHC;"loops";CTR
3480 PRINT CBD
3500 PRINT"Asolute diff";ABS((CTDH-TDHC))
3520 IF ABS((CTDH-TDHC))<10 THEN 3660
3540 IF CTDH>TDHC THEN 3600
3560 BIN=QT-(((MAX)/(10^CBD)))
3580 GOTO 3620
3600 NEXT QT
3620 IF(MAX/(10^CBD))<.01 THEN 3660
3640 NEXT CBD
3660 TMIN=MIN
3680 MIN=MIN+1
3700 BPM=QT/1440
3720 BBLS=BBLS+BPM
3722 PWF=(COP-FL)*.433*SPGR
3724 VEO=1-.2*(PWF/SIBHP)-.8*((PWF/SIBHP)^2)
3726 QFBPD=VEO*QOM
3728 QF=QFBPD/1440
```

```
3730 QA=BPM-QF
3740 REM****insert csg-tbg volume factor bbls/lin foot****
3760 FL=FL+(QA/.0339)
3780 IF FL>PD THEN 3820
3800 GOTO 3960
3820 LPRINT"THE FLUID LEVEL IS BELOW THE PUMP INTAKE -- END OF PGM --"
3840 GOTO 5560
3860 REM****cross sectional area factors are in the next two stmts"****
3880 VWS=328*BPM/60
4000 VNS=110.96*QF/60
4020 IF TMIN>1 THEN GOTO 4165
4040 LPRINT CHR$(12)
4060 LPRINT CHR$(27); "E"
4080 LPRINT"                                                    VEL.     VEL.
     BBLS"
4100 LPRINT"                                          TOTAL     WITH      NO
     PER"
4120 LPRINT"  TIME      FL      Qs      Qf      BPM   BBLS      SHRD     SHRD
     DAY"
4140 LPRINT CHR$(27); "F"
4160 LPRINT
4165 IF QA<.005 THEN 4180
4170 IF TMIN/15=INT(TMIN/15) THEN 4180
4175 GOTO 4440
4180 LPRINT TAB(3)
4200 LPRINT USING "####    ";TMIN;
4220 LPRINT USING "#####   ";FL;
4240 LPRINT USING "##.##   ";QA;
4260 LPRINT USING "##.##   ";QF;
4280 LPRINT USING "##.##   ";BPM;
4300 LPRINT USING "####.##      ";BBLS;
4320 LPRINT USING "##.##   ";VWS;
4340 LPRINT USING "##.##   ";VNS;
4360 LPRINT USING "#####.#   ";QT
4380 REM***the following goto deletes diagnostic printout***
4400 GOTO 4440
4420 LPRINT"qt= ";QT;"  max= ";MAX;"    incr=";INCR
4440 IF QA<.005 THEN 5560
4460 IF CBD>3 THEN 4500
4480 GOTO 4540
4500 CBD=CBD-1
4520 BIN = QT-(((MAX)/(10^CBD)))
4540 GOTO 3060
4560 REM*****************************
4580 REM*open logical file to write
4600 REM*****************************
4620 OPEN "O",1,F$
4640 RETURN
4660 REM*****************************
4680 REM*open logical file to(read
4700 REM*****************************
4720 OPEN "I",1,F$
4740 RETURN
4760 REM*****************************
4780 REM*close logical file
4800 REM*****************************
```

```
4820 CLOSE #1
4840 FCL=-1
4860 RETURN
4880 REM*******************************
4900 REM*print record to file
4920 REM*******************************
4940 PRINT #1,P$,CR$;
4960 RETURN
4980 REM*******************************
5000 REM*read record from file
5020 REM*******************************
5040 INPUT #1,P$
5060 P=ST
5080 IS=IS+1
5100 IF EOF(1)=-1 THEN 4760
5120 RETURN
5140 REM*********************************
5160 REM*initialise disk
5180 REM*********************************
5200 RETURN
5220 REM*********************************
5240 REM*warning message
5260 REM*********************************
5280 REM***********************************
5300 REM*disk error routine
5320 REM***********************************
5340 RETURN
5360 BBL=QT
5380 R=(DIA/12)*.25
5400 Q=(5.614*BBL)/86400!
5420 A=((3.14159*(DIA/12)^2))/4
5440 V=Q/A
5460 G=1/.54
5480 S=((V)/(1.318*C*(R^.63)))
5500 FFFT=1000*((S)^G)
5520 FLOSS=FFFT*(PD/1000)
5540 RETURN
5560 CHDIR "\"
```

What is claimed is:

1. A method of inhibiting the production of sand and other macroscopic particles in a well system producing fluid from a formation through a submersible pump, comprising the repeated performance of the following steps:

(a) measuring the rate of fluid production over a set time interval;

(b) estimating fluid pressure in the region of the formation from the rate of fluid production and fixed physical measurements of the submersible pump and well system;

(c) regulating the rate of fluid production from the formation in response to the estimated fluid pressure in the region of the formation according to a predetermined profile of fluid production versus time, thereby maintaining the rate of change of fluid pressure in the region of the formation below a predetermined limit.

2. The method of claim 1, wherein the rate of fluid production is regulated by selectively varying the frequency of alternating current delivered to an electric motor providing mechanical power to the submersible pump.

3. The method of claim 1, wherein the rate of fluid production is regulated by selectively varying the rate at which a quantity of the fluid produced is diverted into the well to increase or decrease the fluid pressure of the formation.

4. The method of claim 1, wherein the rate of fluid production is regulated by selectively changing the size of an aperture through which the fluid produced passes, so that surface pressure exerted on the fluid is increased or decreased.

* * * * *